US006148811A

United States Patent [19]

Miller

[11] Patent Number: 6,148,811

[45] Date of Patent: Nov. 21, 2000

[54] COMBINED BURNER AND GRATE

[75] Inventor: Mark Lloyd Miller, Niskayuna, N.Y.

[73] Assignee: General Electric Company, Schenectady, N.Y.

[21] Appl. No.: 09/263,581

[22] Filed: Mar. 8, 1999

[51] Int. Cl.[7] ..... F24C 3/00

[52] U.S. Cl. ..... 126/39 R; 126/394; 126/39 N

[58] Field of Search ..... 126/39 R, 39 H, 126/39 N; 239/556, 557

[56] References Cited

U.S. PATENT DOCUMENTS

| | | | |
|---|---|---|---|
| 424,852 | 4/1890 | Bradley | 139/557 |
| 1,293,669 | 2/1919 | Barber | 239/557 |
| 1,463,592 | 7/1923 | Robinson | 239/557 |
| 1,818,222 | 8/1931 | Hughes | 239/557 |
| 1,939,476 | 12/1933 | Werner | 239/557 |
| 3,062,275 | 11/1962 | Reed | 239/557 |
| 3,592,180 | 7/1971 | Kweller et al. | 126/39 H |
| 5,249,958 | 10/1993 | Freber | 126/39 R |
| 5,842,849 | 12/1998 | Huang | 126/39 R |
| 5,865,615 | 2/1999 | Simpson et al. | 126/39 H |

*Primary Examiner*—Ira S. Lazarus
*Assistant Examiner*—David Lee
*Attorney, Agent, or Firm*—Patrick K. Patnode; Marvin Snyder

[57] ABSTRACT

A combined burner and grate structure for use in connection with a gas range includes one or more burner elements. Each burner element has one or more fuel inlets, one or more fuel outlets disposed on one or more side surfaces, and a top surface. A horizontal planar support for a cooking vessel is made up of the top surface of each burner element. A gas rangetop can include one or more of these combined burner and grate structures.

6 Claims, 4 Drawing Sheets

COMBINED BURNER AND GRATE

BACKGROUND OF THE INVENTION

This invention relates to a combined burner and grate structure for use in connection with a gas range, or cooking stove.

Gas ranges are a popular type of cooking appliance used in homes. Unlike cooking with electricity, cooking with a gas flame provides precise control. The flame reacts instantly to operation of the controls of the burner, with immediate results on the state of the material being heated. It is particularly advantageous to be able to turn down the flame under a pot and bring the liquid within the pot from a boil to a simmer almost immediately. The flame may be selectively turned on or off, or raised or lowered in intensity by adjusting the controls. In addition, the level of heat may be infinitely varied.

A conventional gas rangetop or cook top typically includes two to six cooking sites where a cooking vessel, such as a pot or a pan, may be heated by a flame. These cooking sites typically include a burner, a burner pan situated underneath the burner, and a separate grate for supporting the cooking vessel above the flame. Each burner may be individually controlled.

While cooking with an open flame on a gas range is advantageous, conventional ranges have some disadvantages. A conventional gas range, typically having many component parts, is not very easy to clean. In addition, a gas range has a relatively cluttered appearance because of the burners and grates situated on the top surface. Finally, at very low heat, conventional gas burners may become unstable and unable to maintain a flame.

Modern kitchen design is moving toward sleeker, cleaner, less cluttered surfaces. For example, a popular and stylish type of range features a top cooking surface having radiant burners for cooking hidden below the surface. The surface is essentially featureless, and so has an uncluttered appearance. This type of range is also marketed as easy to clean.

There is therefore a need for a gas range having open flame burners for cooking which has a top cooking surface with an uncluttered appearance. There is also a need for a gas range having a top surface which is easy to clean. There is further a need for a burner for a gas range which can maintain very low heat under stable conditions.

SUMMARY OF THE INVENTION

The combined burner and grate structure of the present invention comprises one or more burner elements, each burner element comprising one or more fuel inlets, one or more fuel outlets disposed on one or more side surfaces, and a top surface, and a horizontal planar support for a cooking vessel, the horizontal planar support having a center point, and comprising the top surface of each burner element. The present invention also includes a gas rangetop comprising one or more of these combined burner and grate structures.

DETAILED DESCRIPTION

Figure 1:
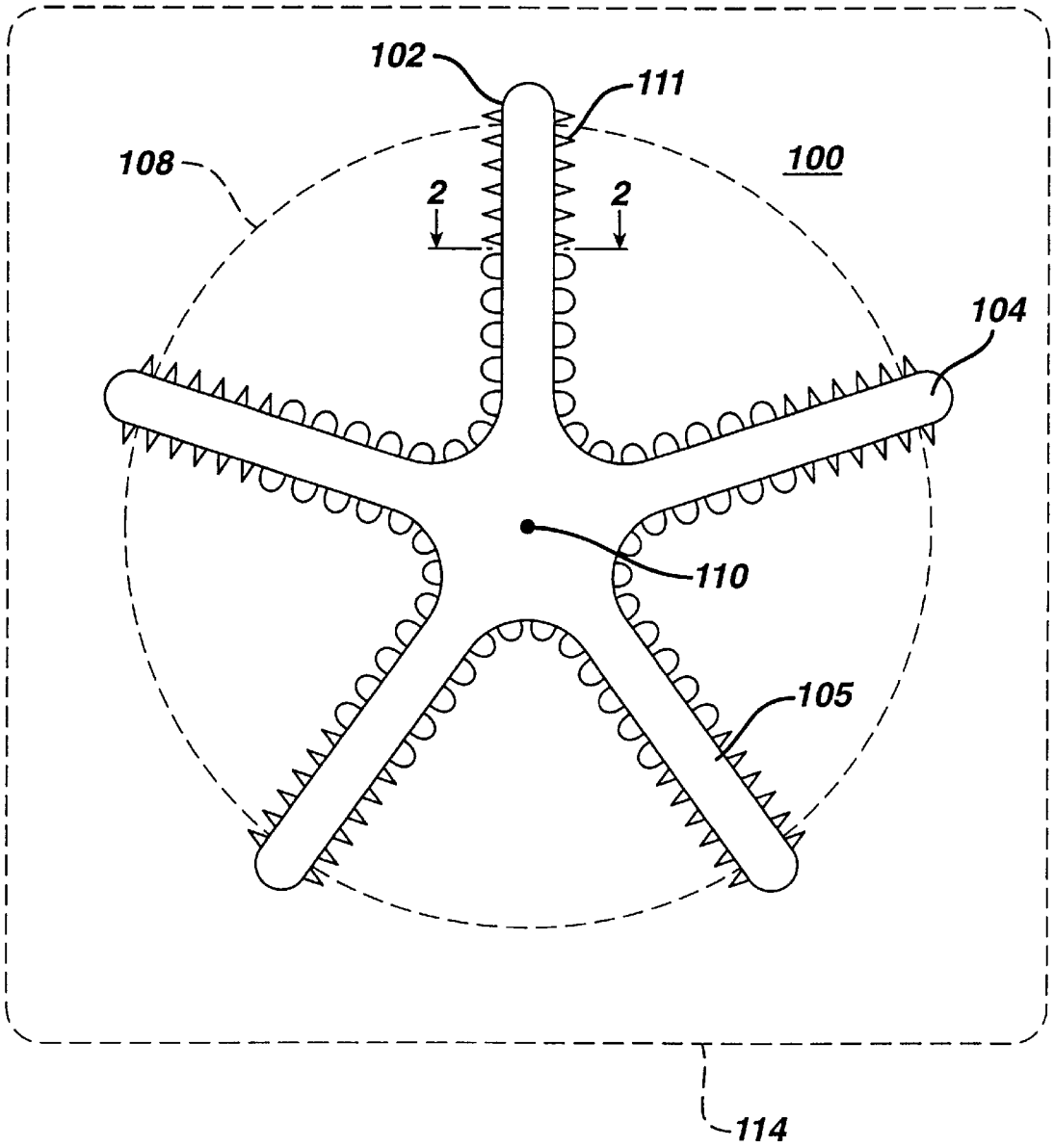
FIG. 1 is a top view of one embodiment of a combined burner and grate structure or unit of the present invention.

A better understanding of the invention may be gained by reference to the drawings. FIG. 1 is a top view of a combined burner and grate structure or unit 100 of the present invention. Combined burner and grate unit 100 includes burner element 102 and integral support 104. Support 104 forms a substantially horizontal surface, made up of top surface 105 of burner element 102. The function of support 104 is to bear a cooking vessel 108, (shown in phantom) maintaining vessel 108 in a stable position and preventing vessel 108 from tipping. Thus, in the context of the present invention, "substantially horizontal" means relatively flat, even, and level. Support 104 includes center point 110.

Fuel used in the combined burner and grate unit of the present invention may be natural gas, methane, propane or other hydrocarbons existing in the vapor phase at room temperature. An igniter for the burner is conveniently located at or near center point 110, but may be placed in any location where activation of the igniter initiates burning of the fuel. A mixture of fuel and air may be thereby ignited, resulting in flames 111.

Burner element 102 consists of five elongated arms radiating from and disposed symmetrically with respect to center point 110. Any number of arms may be employed, however, consistent with stable support of cooking vessel 108. For example, three arms may be sufficient to seat cooking vessel 108 without rocking or tipping, but it may be desired to use additional arms for additional support, or for other design reasons. The arms may be arranged symmetrically or asymmetrically with respect to center point 110. Further, configurations of combined burner and grate unit 100 which consist of a single burner element 104, other than the configuration having several elongated arms radiating from center point 110 shown FIG. 1, may be employed. These configurations include a circle, square, triangle, or other simple geometric figures. In addition, although combined burner and grate unit 100 consists of a single burner element, in some embodiments of the invention, combined burner and grate unit 100 may comprise more than one burner element.

Combined burner and grate unit 100 may be fabricated as an integral part of the top surface of the range or as one or more separate piece(s). Unit 100 may be connected, attached or joined to a base 114. Base 114 may be a separate bottom plate or may be the top surface of the range. FIG. 1 shows an embodiment in which unit 100 is fabricated as a separate piece, and base 114 is the top surface of the range. The function of base 114 is to enclose any cavity within burner element 104. Where base 114 is a separate plate, base 114 may be composed of metal, or any other material suitable for closing off a cavity within burner element 104, which material is resistant to the heat generated during operation of the burner.

Figure 2:
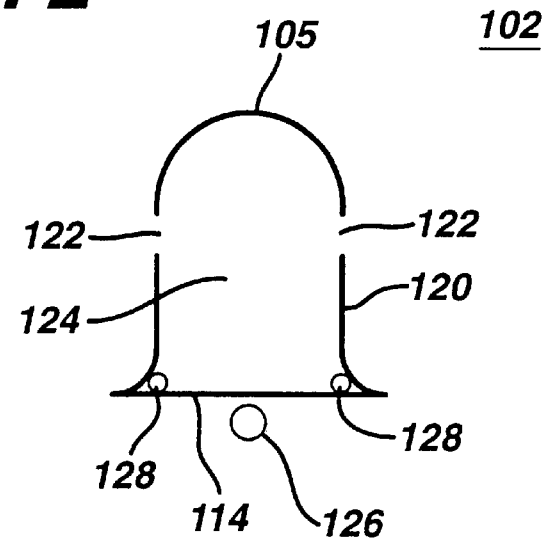
FIG. 2 is a vertical cross-section of a burner element of the present invention, taken along line 2—2 of FIG. 1.

FIG. 2 is a vertical cross-section of an arm of a burner element 102. Burner element 102 is composed of top surface 105 and side surfaces 120. As discussed above, a cooking vessel may rest directly on a top surface 105. In this way, top surface 105 functions as a grate. Side surfaces 120 include fuel outlet(s) 122. Fuel outlet 122 is shown as a simple hole in side surface 120 in the drawing, but other arrangements for providing outlets for fuel are within the scope of the present invention. For example, fuel outlet 122 may consist of a hole with a premade fitting inserted therein. Other designs for fuel outlets which function as gas jets are known to those skilled in the art, and are included within the scope of the invention.

Fuel outlet(s) 122 communicate with cavity 241, which may contain fuel delivered by fuel line 126. Each arm of burner element 102 may have one or more associated fuel lines, or burner element 102 may be served by a single fuel line. Alternately, fuel outlet(s) 122 may be connected directly to a secondary fuel line (not shown) which delivers fuel from fuel line 126 to each fuel outlet 122 in side surface 120. In this embodiment, each secondary fuel line has an outlet and fuel outlet 122 consists of the outlet of the secondary fuel line surrounded by an annular space for entrainment of primary air for combustion. Cavity 124 may communicate with the outside atmosphere in this embodiment.

In the embodiment shown in FIG. 2, burner element 102 is an integral part of the top surface of the range, and base 114 is a separate bottom plate. Burner element 102 may be attached to base 114 by seal 128 to prevent unwanted fuel leakage. If desired, seal 128 may be supplemented or replaced by fasteners or adhesives.

Figure 3:
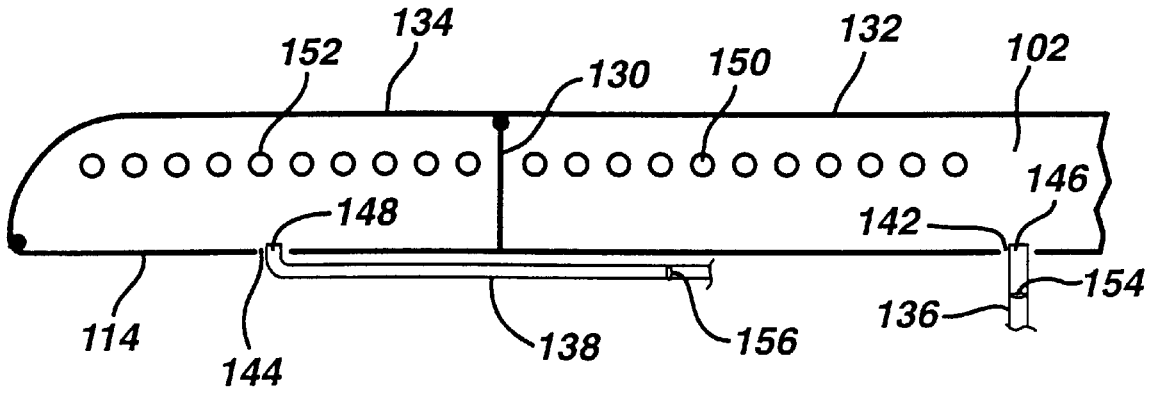
FIG. 3 is a cross section of a burner element of the present invention having a partition between a first or inner section and a second or outer section.

FIG. 3 shows a cross section of an arm of burner element 102 having a partition 130 between a first or inner section 132 and a second or outer section 134. Each section has an associated fuel supply or line, fuel supply or line 136 being associated with inner section 132 and fuel supply or line 138 being associated with outer section 134. At inlets or entrances 142 and 144 to inner section 132 and outer section 134, respectively, outlets 146 and 148 of fuel supply or lines 136 and 138, respectively, are surrounded by an annular opening for entraining primary air for combustion. Sizing of inlets or entrances 142 and 144 is determined by design parameters. While inlets or entrances 142 and 144 are shown as openings in base 114, the inlets or entrances may be located on a side surface. Inlets or entrances 142 and 144 may be absent from burner element 102, in particular where inner fuel outlets 150 and outer fuel outlets 152 are connected to a secondary fuel supply or line, as described above.

In addition to a combination burner and grate, the present invention also provides for a variable-sized burner. Such a burner may exhibit less instability at very low heat. Partition 130, separate fuel supply or lines 136 and 138 for inner section 132 and outer section 134, respectively, and valves 154 and 156 allow fuel to be supplied to either outlets 150 of inner section 132 or outlets 152 of outer section 134 or to both as desired. Either outlets 150 of inner section 132 or outlets 152 of outer section 134 may then be ignited. Where only outlets 150 or outlets 152 are ignited, very low heat under stable conditions may be provided to a cooking vessel. In addition, when only outlets 150 of inner section 132 are supplied with fuel and ignited, the area having active flames is smaller, and is sized for a smaller cooking vessel.

Figure 4:
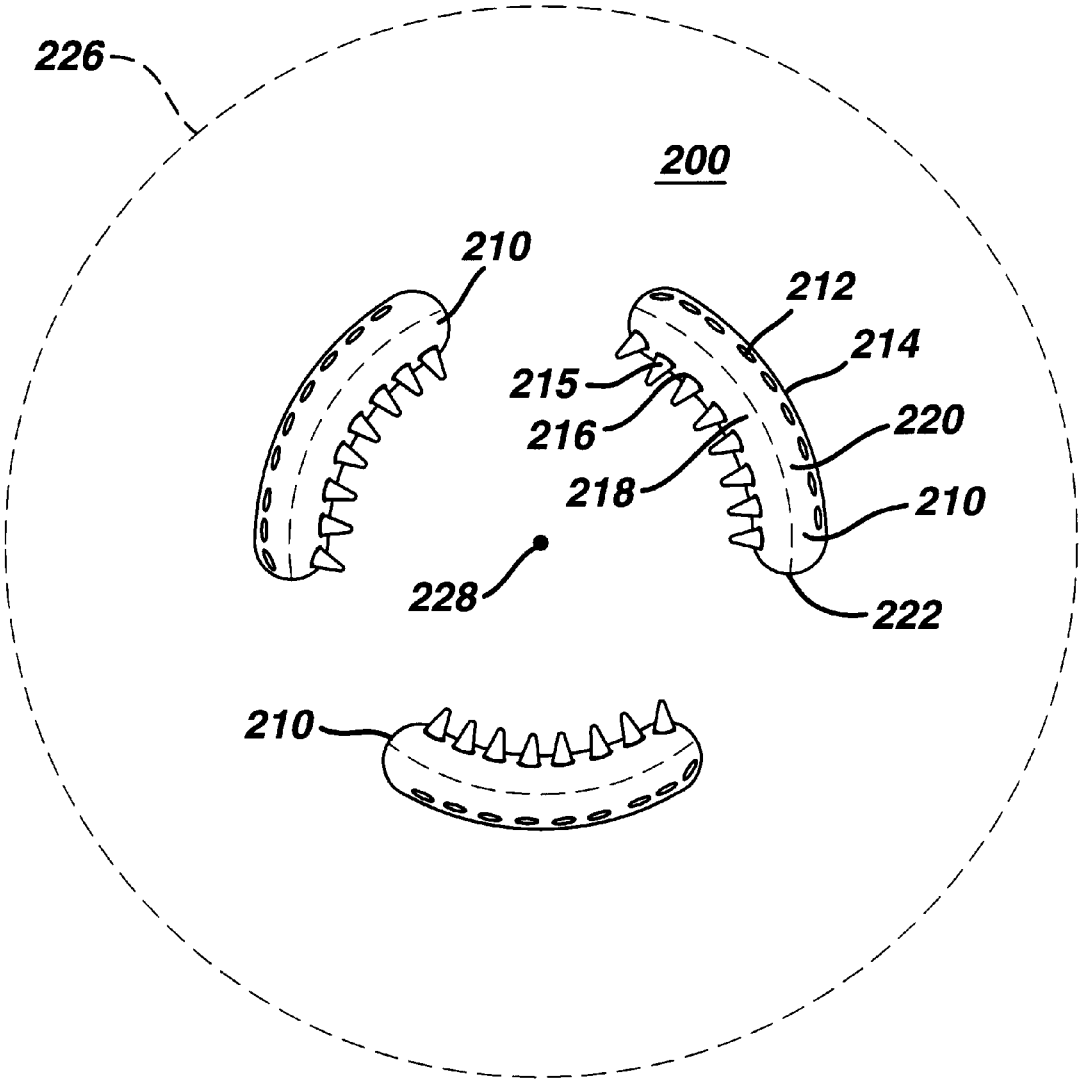
FIG. 4 is a top view of a combined burner and grate unit having curved, elongated burner elements.

FIG. 4 depicts a top view of combined burner and grate unit 200 which is comprised of three curved, elongated burner elements 210. Each burner element 210 has outer fuel outlets 212 disposed along an outer side surface 214; inner fuel outlets 215 may also be disposed along inner side surface 216, if desired. The interior of burner element 210 may be separated into inner section 218 and outer section 220 by partition 222. As described above for FIG. 3, inner section 218 and outer section 220 may have separate fuel supply or lines with separate valves (not shown). Therefore, either outer fuel outlets 212 or inner fuel outlets 215, or both, may be ignited. It may be desirable, for example, to produce a flame 224 only in inner fuel outlets 215 where the cooking vessel is small, or only in inner fuel outlets 215 or outer fuel outlets 152 when very low heat is desired.

The shape, number and configuration of burner elements 210 may be varied, consistent with stable support of the cooking vessel, and proper combustion of fuel. Other shapes, including straight and angled, in addition to curved, may be employed. The number of burner elements may be as few as one or two, if the element(s) are configured such that a cooking vessel is supported without danger of tipping or spilling. The number of burner elements may be as many as desired to implement an aesthetic design.

Burner elements according to the present invention may be arranged or disposed symmetrically or asymmetrically with respect to center point 228. In this context, "symmetrical" and "symmetrically" refer to a correspondence in size, shape and relative position of burner elements or parts of burner elements on opposite sides of a dividing line or about a center, including radial symmetry. "Asymmetrical" and "asymmetrically" mean not symmetrical, or not possessing symmetry. FIG. 4 shows burner elements 210 circumferentially disposed with respect to a phantom circle 226 and symmetrically disposed with respect to a center point 228, possessing both radial and bilateral symmetry. Although the embodiment depicted in FIG.4 is a symmetrical configuration of burner elements, the present invention also encompasses configurations wherein burner elements 210 are disposed asymmetrically with respect to circle 226 or center point 228.

Figure 5:
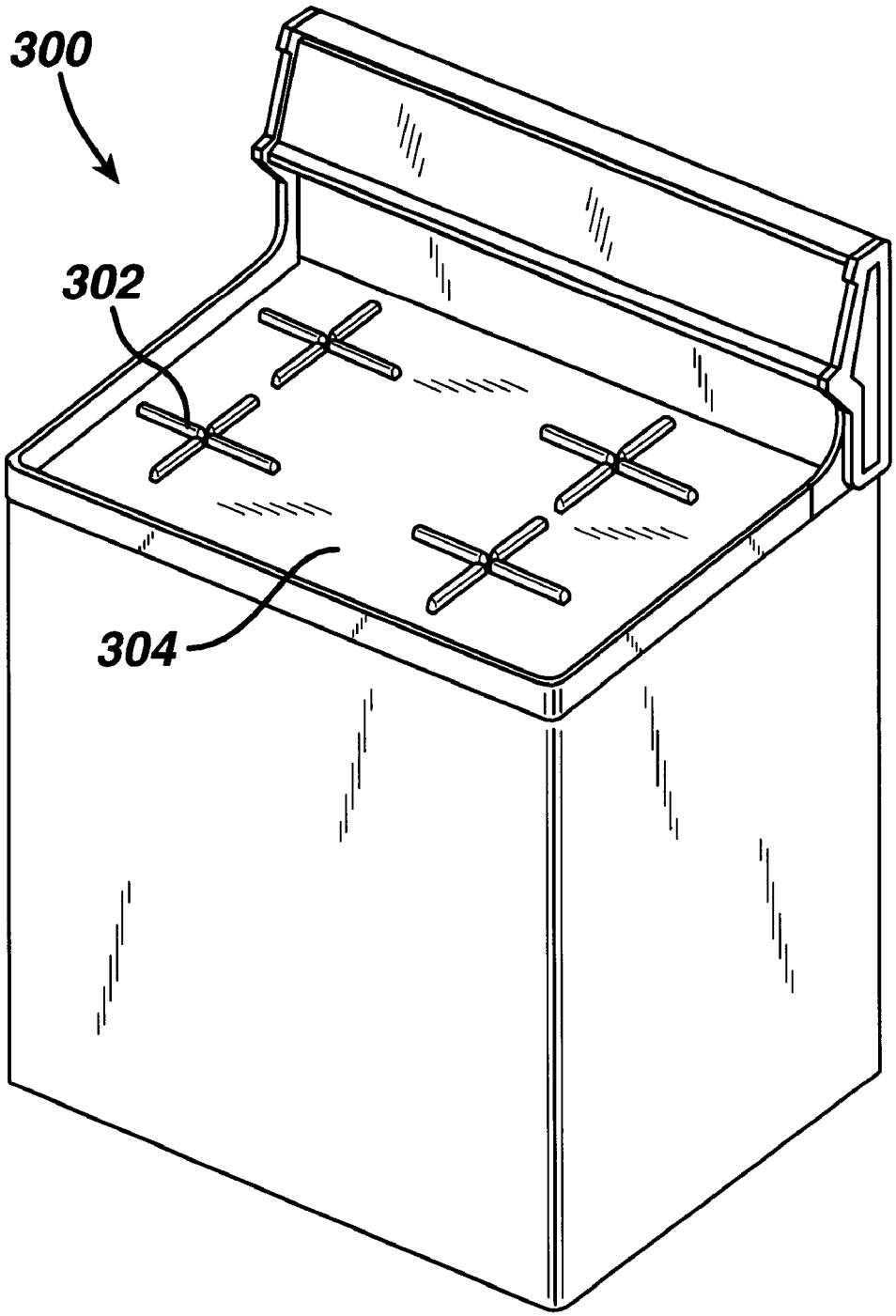
FIG. 5 is a perspective view of a gas rangetop of the present invention comprising combined burner and grate units.

FIG. 5 shows rangetop 300 comprising multiple combined burner and grate units 302 of the present invention. "Rangetop" is defined herein as the cooking surface of a gas range including gas burners and horizontal planar surfaces surrounding said burners for holding cooking tools and implements. Rangetop 300 conveniently comprises four combined burner and grate units, however, any desired number of combined burner and grate units may be incorporated in rangetop 300.

Rangetop 300, including combined burner and grate units 302, may be composed of a glass-ceramic material. Such glass-ceramics are commercially available from several sources and are typically lithium aluminosilicates with small amounts of additives. These glass-ceramics are typically made by melting an appropriate glass composition, forming an article of the glass composition to be net shape or nearly net shape, and then heat-treating it, thereby causing the glass to convert largely to crystals. This results in a composite structure comprising crystals in glass. This glass-ceramic may be made to be very resistant to thermal shock, to degradation by abrasion and to breaking under applied stress or mild impact.

Rangetop 300, including combined burner and grate units 302, may also be composed of metal, including stainless steel, or an enameled metal, including steel or cast iron coated with a ceramic material.

Rangetop 300, including combined burner and grate units 302, may be fabricated as one piece. The one piece rangetop of the present invention maximizes cleanability and minimizes cluttered appearance. A ceramic rangetop may be cast in a one piece mold; a metal rangetop may be cast, formed or pressed in one piece. Alternately, rangetop 300 and combined burner and grate units 302 may be fabricated separately and subsequently joined, attached or connected using methods well known in the art. For example, for a ceramic rangetop, combined burner and grate units 302 may be formed or pressed separately from flat surface 304 of rangetop 300. Combined burner and grate units 302 may be joined to flat surface 304 using fasteners, seals, including glass seals, or adhesives, including silicone rubber adhesives.

While only certain features of the invention have been illustrated and described, many modifications and changes will occur to those skilled in the art. It is, therefore, to be understood that the appended claims are intended to cover all such modifications and changes as fall within the true spirit of the invention.

What is claimed is:

1. A gas rangetop comprising a one piece unit having one or more combined burner and gate structures integrate therewith, each combined burner and grate structure comprising:

one or more burner elements, each burner element comprising one or more fuel inlets, one or more fuel outlets disposed on one or more side surfaces, and a top surface; and a horizontal planar support for a cooking vessel, said horizontal planar support having a center point, and comprising the top surface of each burner element wherein each burner element comprises a first section having a fuel supply, a second section having a fuel supply, and a partition between said first and second sections, whereby fuel is prevent from migrating between said first and said second sections.

2. The gas rangetop of claim 1, wherein said combined burner and grate structure comprises a single burner element.

3. The gas rangetop of claim 2, wherein said burner element comprises a plurality of elongated arms radiating from said center point.

4. The gas rangetop of claim 1, wherein said combined burner and grate structure comprises a plurality of elongated burner elements.

5. The gas rangetop of claim 4, wherein said plurality of elongate burner elements are disposed symmetrically with respect to said center point.

6. The gas rangetop of claim 1 further including a common planar surface surrounding said one or more combined burner and grate structures.

* * * * *